United States Patent [19]

Fishman

[11] Patent Number: 4,774,867

[45] Date of Patent: Oct. 4, 1988

[54] MUSICAL INSTRUMENT TRANSDUCER

[76] Inventor: Lawrence R. Fishman, 76 Grove St., West Medford, Mass. 02155

[21] Appl. No.: 876,238

[22] Filed: Jun. 19, 1986

Related U.S. Application Data

[63] Continuation-in-part of Ser. No. 856,189, Apr. 28, 1986, abandoned.

[51] Int. Cl.[4] ..... G10H 3/18

[52] U.S. Cl. ..... 84/1.16; 84/DIG. 24

[58] Field of Search ..... 84/1.16, DIG.24; 310/330, 331, 328, 334, 345, 340; 174/35 MS, 36

[56] References Cited

U.S. PATENT DOCUMENTS

| | | | |
|---|---|---|---|
| 4,314,495 | 2/1982 | Baggs . | |
| 4,491,051 | 1/1985 | Barcus . | |
| 4,514,247 | 4/1985 | Zola | 84/DIG. 24 |
| 4,657,114 | 4/1987 | Shaw | 84/1.16 |

*Primary Examiner*—S. J. Witkowski

*Attorney, Agent, or Firm*—Wolf, Greenfield & Sacks

[57] ABSTRACT

A transducer for a stringed musical instrument incorporating an electrically conductive ground plane, along with a plurality of piezoelectric transducers and a conductive strip. The ground plane, piezoelectric transducers and conductive strip are secured in an elongated unitary structure with the ground plane and conductive strip disposed on opposite sides of the transducers. A conductive shield is disposed about the unitary structure and electrical leads connect to the ground plane and conductive strip, respectively.

30 Claims, 4 Drawing Sheets

MUSICAL INSTRUMENT TRANSDUCER

RELATED APPLICATIION

This application is a continuation-in-part of Ser. No. 06/856,189 filed Apr. 28, 1986 and now abandoned.

BACKGROUND OF THE INVENTION

The present invention relates in general to a musical instrument transducer, and pertains, more particularly, to a piezoelectric transducer used with a stringed musical instrument and preferably for use with a guitar.

At the present time, the prior art shows a variety of electromechanical transducers employing piezoelectric materials such as described in U.S. Pat. Nos. 3,325,580 or 4,491,051. Most of these piezoelectric transducers are not completely effective in faithfully converting mechanical movements or vibrations into electrical output signals which precisely correspond to the character of the input vibrations. This lack of fidelity is primarily due to the nature of the mechanical coupling between the driving vibratile member and the piezoelectric material. Some of these prior art structures such as shown in U.S. Pat. No. 4,491,051 are also quite complex in construction and become quite expensive to fabricate.

Accordingly, it is an object of the present invention to provide an improved piezoelectric transducer particularly for use with a stringed musical instrument such as a guitar.

Another object of the present invention is to provide an improved transducer as in accordance with the preceding object and which provides for the faithful conversion of string vibrations into electrical signals that substantially exactly correspond with the character of such vibrations.

Still a further object of the present invention is to provide an improved musical instrument transducer as in accordance with the preceding objects and which is relatively simple in construction, can be readily fabricated and which can also be constructed relatively inexpensively.

Another object of the present invention is to provide an improved musical instrument transducer that is readily adapted for retrofit to existing stringed instruments without requiring any substantial modification thereto.

SUMMARY OF THE INVENTION

To accomplish the foregoing and other objects, features and advantages of the invention, there is provided a transducer for a stringed musical instrument that is adapted to be positioned adjacent the instrument strings to receive acoustic vibratory signals therefrom. The transducer comprises an electrically conductive ground plane, a plurality of piezoelectric transducers, each preferably of substantially disc-like shape and adapted to be aligned with an instrument string, and a conductive strip. In an alternate embodiment of the invention the piezoelectric transducers may be of square or rectangular shape. The ground plane is a thin elongated metal sheet preferably of berylium copper and having a right angle end tab. The ground plane may also be of other conductive material such as brass. Each piezoelectric transducer preferably comprises a piezoelectric crystal having a circular shape. In accordance with one version of the present invention, the crystal diameter is on the order of 1/16th inch and the crystal thickness is on the order of 0.020 inch. The conductive strip is preferably comprised of a circuit board including a dielectric baseboard carrying a conductive cladding that defines the conductive strip. There is also preferably provided a resilient electrically-conductive layer disposed between the transducer and conductive strip. This conductive layer is preferred to be of carbon fiber. Means are provided for securing the ground plane, piezoelectric transducers, and conductive strip in an elongated unitary structure with the transducers disposed between the ground plane and conductive strip and spacedly disposed so as to be in alignment with respective strings. In a preferred embodiment of the invention the piezoelectric crystals are bonded to a carbon fiber strip in order to properly align the crystals. The bonding of the crystals on only one face also provides some crystal defamation so as to increase the voltage level of the output signal. A conductive shield is disposed about the unitary structure. Electrical contact is provided between the shield and the ground plane and furthermore electrical leads connect to the ground plane and conductive strip which in turn provides electrical continuity to opposite sides of the crystals. The electrical leads include a first electrical lead soldered to the ground plane and a second electrical lead soldered to the conductive cladding.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Figure 1:
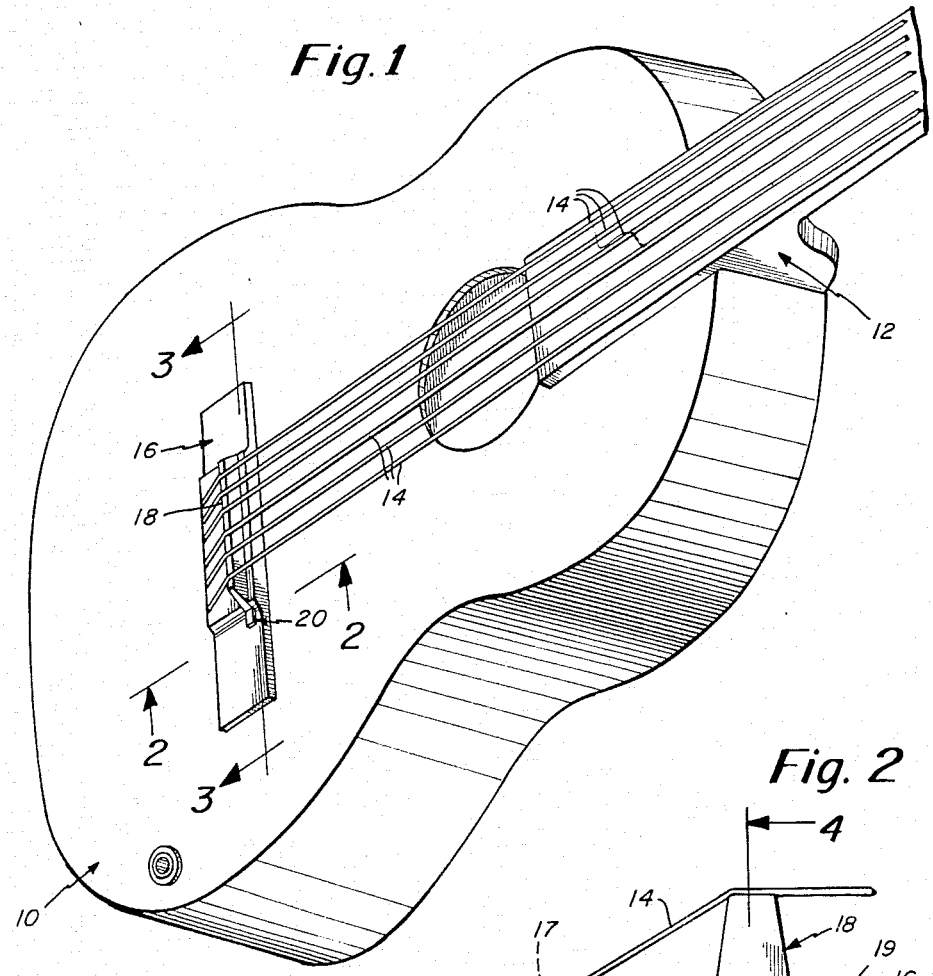
FIG. 1 is a perspective view of a stringed musical instrument and in particular a guitar that has incorporated therein the transducer of the present invention.
Figure 2:
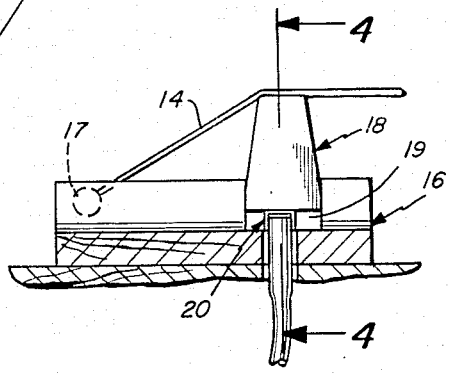
FIG. 2 is a cross-sectional view taken along line 2—2 of FIG. 1.
Figure 3:
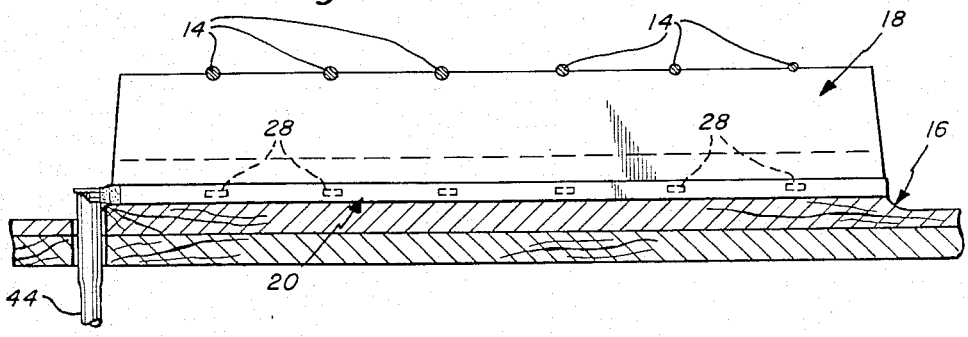
FIG. 3 is a cross-sectional view taken along line 3—3 of FIG. 1 and illustrating the placement of individual crystals relative to the strings.

Reference is now made to the drawings and in particular to FIGS. 1–3. FIG. 1 illustrates a guitar that is comprised of a guitar body 10 having a neck 12 and supporting a plurality of strings 14. In the embodiment disclosed herein, such as illustrated in FIG. 3, there are six strings 14. The strings 14 are supported at the neck end of the instrument, but are not illustrated herein. At the body end of the strings, the support is provided by means of the bridge 16. The bridge 16 includes means, such as illustrated in FIG. 2 for securing the end 17 of each of the strings 14.

The bridge 16 is slotted such as illustrated in FIG. 2 in order to receive the saddle 18. The strings 14 are received in notches in the saddle 18 at the top surface thereof.

In an existing instrument, in order to install the transducer 20 of the present invention, the tension on the strings 14 is removed and the saddle 18 can then be lifted out of the slot in the bridge. The transducer 20 is then inserted in this slot 19. The saddle 18 may then be cut at its bottom end to remove a portion thereof. The portion removed is approximately equal to the height of the transducer 20 so that when the saddle 18 is reinstalled (see FIG. 2) then the saddle will assume the same height above the bridge.

Figure 4:
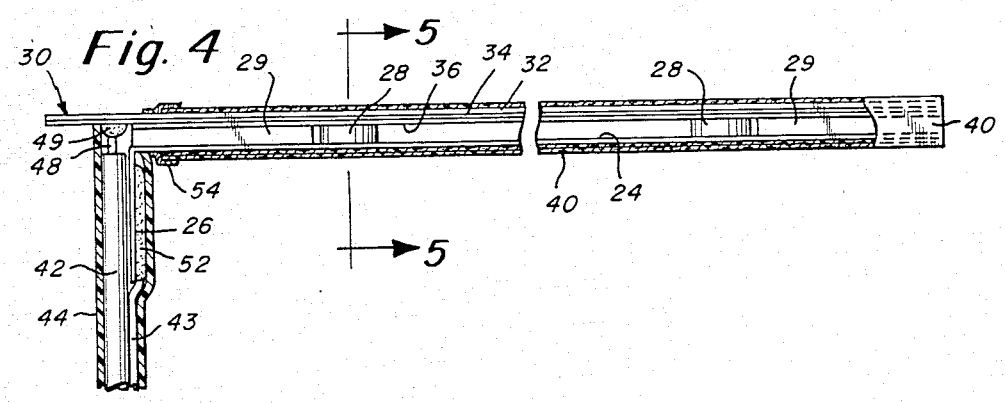
FIG. 4 is a cross-sectional view taken along line 4—4 of FIG. 2 illustrating further details of the musical instrument transducer.
Figure 5:
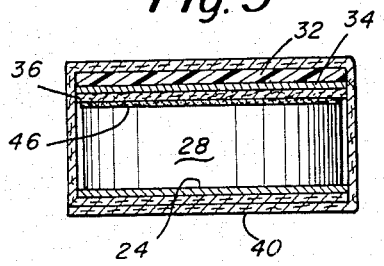
FIG. 5 is a cross-sectional view taken along line 5—5 of FIG. 4 through one of the crystals.
Figure 6:
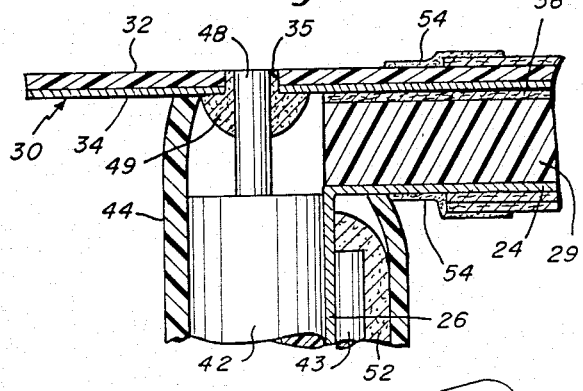
FIG. 6 is a more detailed cross-sectional view showing the portion of the transducer wherein the input leads connect.
Figure 7:
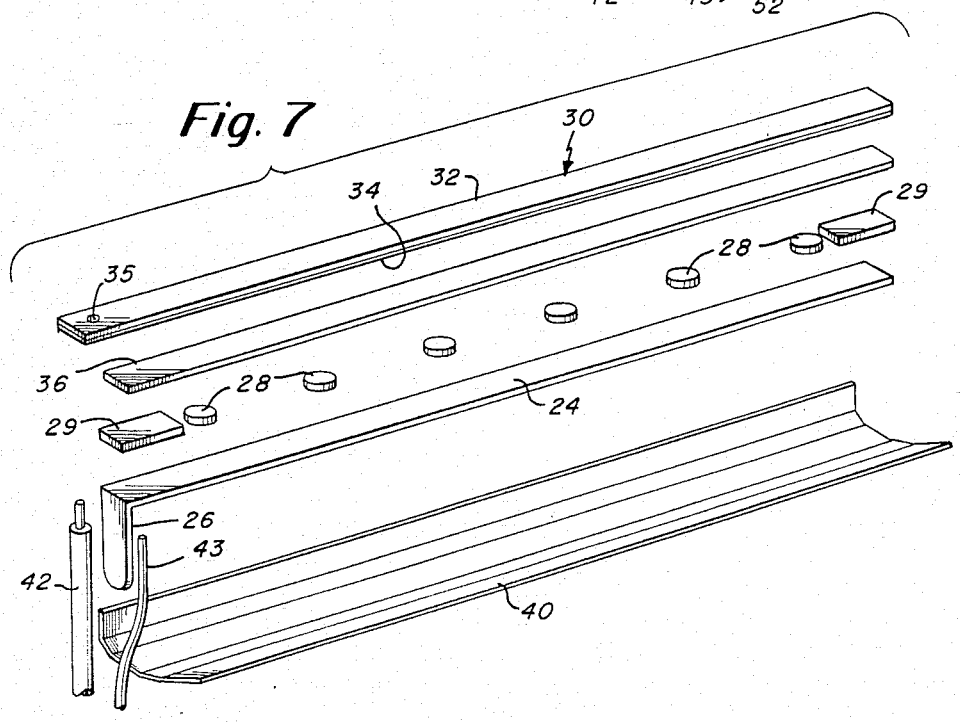
FIG. 7 is an exploded perspective view illustrating the different components that comprise the transducer of the inventin.
Figure 8:
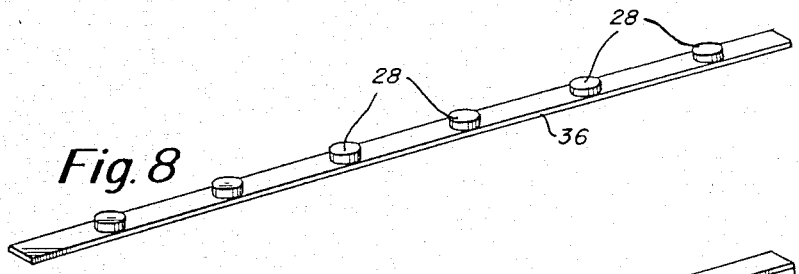
FIGS. 8–12 illustrate sequential assembly steps in the constructing of the musical instrument transducer of this invention.

With regard to the further details of the transducer 20, reference is furthermore made to FIGS. 4–7. In particular, FIG. 7 is an exploded perspective view illustrating the individual components that comprise the transducer. FIG. 6 shows specific details of the connection of the electrical leads to the transducer. FIG. 3 illustrates the specific placement of the piezoelectric crystals as they relate to the strings 14.

The ground plane 24 may alternatively be constructed of a different metal such as brass. The ground plane 24 provides a contact to one side of each of the plurality of piezoelectric crystals 28. As indicated previously, these crystals 28 are disposed in a spaced relationship as indicated in FIG. 3. In this regard, with reference to the crystals 28, it is noted that they are of the disc-shape as illustrated, and in one embodiment are of 1/16th inch diameter by 0.020 inch thick. The electrodes of each crystal are at the respective top and bottom surfaces thereof. Thus, contact to the crystal occurs through the ground plane 24 by virtue of the ground plane contacting the lower electrode of each of the transducers.

The other conductive contact to each of the individual transducers is provided by a conductive strip defined by the elongated circuit board 30. The circuit board 30 includes a dielectric epoxy fiberglass layer 32 having a copper clad layer 34 deposited thereon. It is also noted that the circuit board 30 has a hole 35 at one end thereof for providing a solder connection. In this regard, refer to the detailed cross-sectional view of FIG. 6.

The transducer 20, such as depicted in FIG. 7, also includes a resilient and electrically conductive layer 36 that is disposed adjacent the top side of each of the crystals 28. The layer 36 is conductive and provides electrical conductivity along with the necessary resiliency between the crystals 28 and the copper cladding 34.

A reference has been made herein to the piezoelectric crystals 28. These are illustrated as being of disk or circular shape but could likewise be of other form such as square or rectangular. Although reference has been made to these devices as being piezoelectric crystals a more technically accurate term is piezoelectric ceramic. A crystal usually refers to a single crystal structure such as quartz. However, the materials employed herein are amorphous structures containing many thousand individual crystals. They are constructed by combining different elements in their powder form and subjecting them to high temperatures which forms a fused ceramic containing thousands of crystals. They are then subjected to high DC voltages which tends to align a majority of the dipoles and thus gives the entire structure a common polarity.

In FIG. 7 there is shown the wrapping paper 40. This is preferably a parchment having a high linen content. This is preferably 100% rag paper that provides a complete wrapping about the transducer such as illustrated in the cross-sectional view of FIG. 5. The paper 40 is painted with a nickel-filled colloid (paint). This colloid provides a shield about the transducer and in an alternate embodiment, instead of being a nickel-filled colloid may be filled with any conductor such as graphite or copper. This combination of a parchment type paper along with the nickel-filled colloid (paint) provides an extremely effective shield about the transducer and provides it in a relatively simple manner. In addition to providing an extremely effective shield, the combination of paper and paint rapping represent a substantial improvement over prior shielding techniques such as described in U.S. Pat. No. 4,491,051. Because the paper is a dielectric itself there are no shorting problems. This arrangement also eliminates the need for addition layer of insulating material that definitely is necessary when using a metal foil such as in U.S. Pat. No. 4,491,051.

Finally, in FIG. 7 there are illustrated the end spacers 29 which are preferably of a dielectric material and which may be made of a compressible material. Also disclosed are a pair of leads 42 and 43 that connect respectively to the circuit board 30 and the ground plane 34 as will be described in further detail hereinafter.

As indicated previously, the crystals 28 are of relatively small size and are provided with electrodes on the top and bottom surface thereof. It has been found that a circular type of crystal is better than a rectangular-shaped one. With the rectangular crystal, there are edge effects that interfere with proper signal transduction. Such edge effects are substantially reduced by the use of circular crystals.

FIG. 4 is a cross-sectional view showing the spaced crystals and furthermore illustrating the ground plane 24 and its associated tab 26. FIG. 4 also illustrates the connection of the electrical leads to the transducer. This includes the leads 42 and 43. The lead 43 is soldered to the tab 26. The lead 42 couples to the solder hole 35 for connection to the circuit board 30.

FIG. 5 is a cross-sectional view taken along line 5—5 of FIG. 4 showing the different layers that comprise the transducer. It is noted in FIG. 5 that there is also illustrated, a conductive adhesive layer 46 that attaches the crystal 28 to the carbon fiber layer 36. It is noted in FIG. 5 that an adhesive layer is only provided on one side of the crystal 28 thus bonding the crystal on only one side thereof. A discussion follows hereinafter regarding the advantages of such bonding technique. FIG. 5 also clearly illustrates the wrapping of the outer shield formed by the essential single wrapping of the paper 40.

FIG. 6 is a detailed cross-sectional view showing in particular the connection of the electrical leads to the transducer. In this regard it is noted that the leads 42 and 43 have a plastic shrink tubing 44 extending thereover. The lead 42 has its center conductor 48 soldered at 49 to the circuit board 30, to in particular provide a conductive connection to the cladding 34. As indicated previously, the lead 43 has its conductor soldered as at 52 to the tab 26 of the ground plane 24. FIG. 6 illustrates one embodiment for providing conductivity between the shield and ground plane. This is illustrated with a conductive paint 54 which it is noted provides electrical conductivity from the shield to the ground plane. The paint is applied so that there is no electrical conductivity to the circuit board. In this regard refer also to the preferred form of providing conductivity as illustrated and described hereinafter in FIGS. 13A and 13B.

Figure 9:
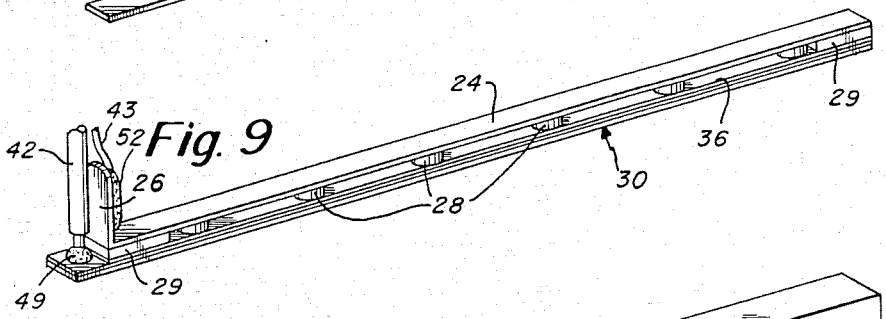
Figure 10:
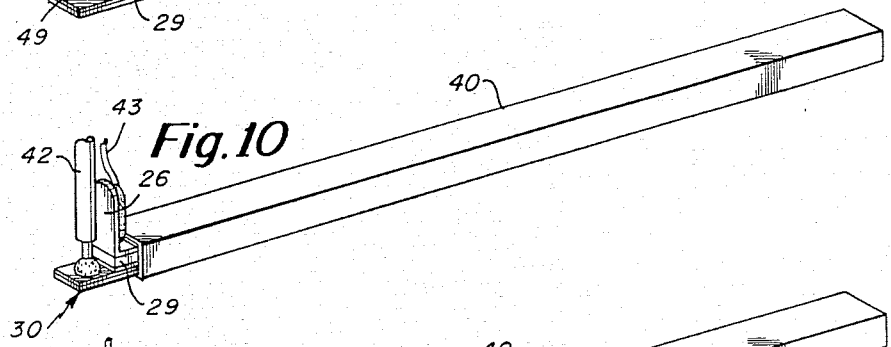
Figure 11:
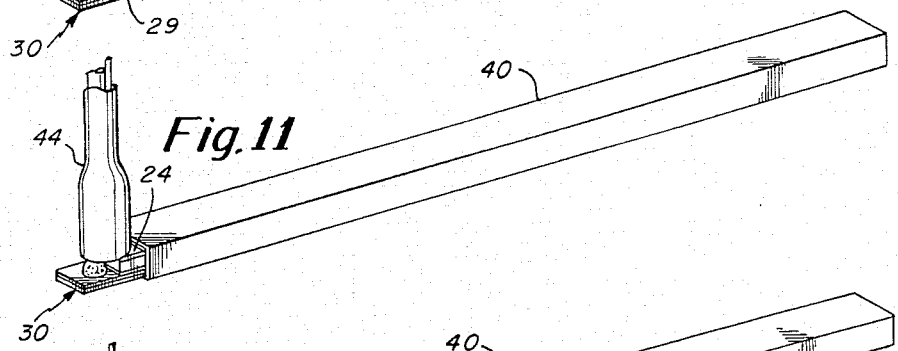
Figure 12:
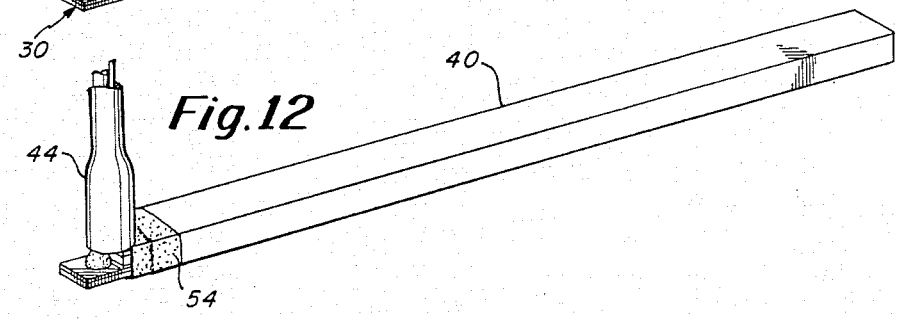

FIGS. 8–12 show the sequence of steps in constructing the device of the present invention. First, the piezoelectric crystals 28 are secured to the carbon fiber strip 36 by a conductive epoxy, illustrated in FIG. 5 as the conductive layer 46. The crystals 28 are spaced in the manner illustrated in FIG. 3 relative to string spacing. The electrical leads 42 and 43 may then be soldered to the circuit board 30 and the tab 26 and the circuit board 30 and ground plane 24 along with the spacers 29 are then formed into a unitary structure as illustrated in FIG. 9. The paper jacket 40 is then wrapped about the structure leaving the leads 42 and 43 exposed as indicated in FIG. 10. FIG. 11 then illustrates the heat shrink tube 44 disposed over the leads 42 and 43. Finally, in FIG. 12 the paper is painted with the conductive nickel paint in a manner to provide conductive connection to the ground plane, but no conductivity to the circuit board.

Figure 13A:
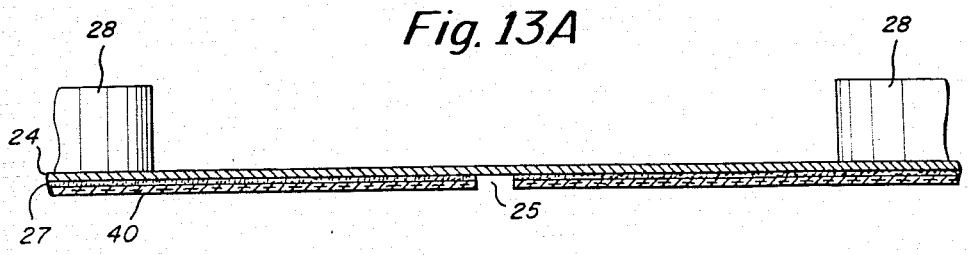
FIGS. 13A and 13B illustrate sequential assembly steps for a preferred embodiment of providing electrical contact from the ground plane to a shield.
Figure 13B:
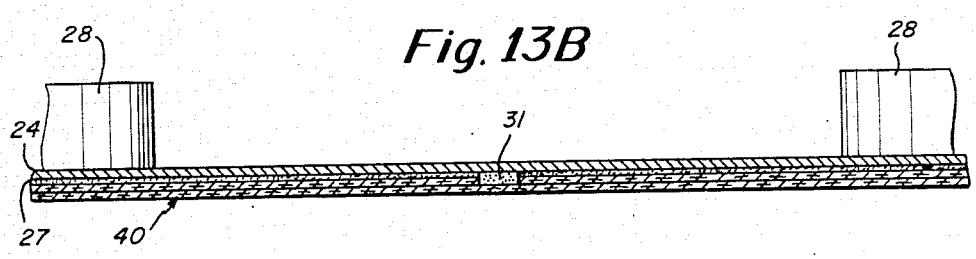

Reference has been made herein before to one technique of grounding the shield to the ground plane 24. However, a preferred technique is now described in FIGS. 13A and 13B. In FIGS. 13A and 13B the same reference characters will be used as previously referred to.

Although the technique of FIG. 6 is satisfactory one problem is that the conductive paint 54 provides a bump at the top and bottom of the device. This makes it more difficult to have flat full face contact between the top of the device and the saddle, and between the bottom of the device and the bridge slot.

Thus, with reference to FIG. 13A there is shown a fragmentary view illustrating the transducers 28 resting upon but not bonded to the ground plane 24. A small hole illustrated at 25 is punched through the painted paper 40. The ground plane 24 is attached to the inside of the paper 40 with an adhesive as illustrated in FIG. 13A at 27. The adhesive 27 is preferably not used in the area where the hole is provided. The hole is then filled with conductive paint 31 as illustrated in FIG. 13B. This provides a conductive path in the outside of the paper and the ground plane 24. FIG. 13B then shows an additional layer of paper. The paper is wrapped into a tube about the device and is sealed with an adhesive. In this connection it is noted that the paper when processed in the fabrication step has already been painted with the metal filled colloid. And thus the conductive paint 31 is applied this may fill the hole and also overlap to contact the metal paint to provide the proper conductivity between the shield and ground plane.

Reference has been made herein before to the fact that each of the piezoelectric crystals 28 are bonded only on one side to a relatively rigid member which in the disclosed embodiment is the carbon fiber strip 36. This has been illustrated previously in FIG. 8. The ground plane 24 on the other side of the crystals is not bonded to the crystals and thus the crystals are only bonded on one side. A carbon fiber strip has been chosen as the preferred form although other conductive metal materials may also be employed. The described method of construction provides a unitary structure (carbon fiber strip/crystals) that is held in a somewhat sliding configuration with regard to the ground plane and the conductive strip. This provides a very flexible structure that can readily bend and conform to any irregularities in the slotted bridge.

The bonding of the crystals to the carbon fiber strip provides a way to maintain the proper crystal location with regard to the strings yet have the crystals relatively isolated. This is a clear improvement over prior art techniques described in U.S. Pat. No. 4,491,051. In that patent they maintain crystal location by employing spacers between the crystals. This is undesirable because of the side-to-side contact between the crystals and the spacers.

Because the crystals are sensitive to vibration in the shear mode as well as in the compressive mode, any undesirable vibrations, such as instrument body noise, which may create vibrations in the lateral direction are thus translated to all of the crystals which in turn add them to the output signal. In the case of isolated crystals, these lateral vibrations are not picked up, and the resulting output is a much clearer representation of the actual string vibrations. In this regard note, for example, in FIG. 4 of the present application as well as in FIGS. 7 and 9 that there is a clear void space between each of the crystals 28.

The bonding of the crystals on only one face also provides an increase of voltage level to the output signal. As the crystal is compressed it tends to deform. Since only one surface is restricted by the bond, the resulting deformation causes bending to occur at the bonded surface. This bending stresses the entire surface and thus adds to the overall output voltage. The resulting signal is larger than that of an unbonded crystal under simple compression.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A transducer system for a stringed musical instrument adapted to be positioned under the instrument saddle for coupling vibratory action from the instrument strings via the saddle to said transducer system, said transducer system comprising;

an electrically conductive ground plane, a plurality of piezoelectric transducers each adapted to be aligned with an instrument string and each having one and another side, said ground plane positioned at the one side of said transducers remote from the instrument strings and receiving the one side of the transducers in electrically coupling contact therewith, a conductive strip positioned at the other side of said transducers, a resilient and electrically conductive layer disposed between said piezoelectric transducers and conductive strip, conductive adhesive means for securing the other side of the piezoelectric transducers to the conductive layer to form an elongated unitary structure that includes said ground plane with the piezoelectric transducers disposed between the ground plane and conductive layer and spacedly disposed so as to be in alignment with respective strings, conductive shield means disposed about said unitary structure, means providing electrical contact between the shield means and ground plane, and electrical lead means connected to said ground plane and conductive strip.

2. A transducer system as set forth in claim 1 wherein said ground plane is a thin elongated beryllium copper sheet having a right angle end tab.

3. A transducer sytem as set forth in claim 1 wherein each piezoelectric transducer comprises a piezoelectric crystal having a cylindrical shape.

4. A transducer sytem as set forth in claim 3 wherein the crystal diameter is on the order of 1/16th inch and the crystal thickness is on the order of 0.020 inch.

5. A transducer as set forth in claim 1 wherein said conductive layer comprises carbon fiber.

6. A transducer as set forth in claim 5 wherein said conductive strip is comprised of a circuit board including a dielectric base board carrying a conductive cladding defining the conductive strip.

7. A transducer as set forth in claim 1 wherein said shield means comprises an absorbent paper wrapped about the unitary structure and a conductive paint applied to said paper.

8. A transducer as set forth in claim 6 wherein said lead means includes a first electrical lead soldered to the ground plane and a second electrical lead soldered to the conductive cladding.

9. A transducer as set forth in claim 1 wherein said ground plane has an end tab and said electrical lead means comprises a coaxial cable having an outer conductor adapted to be secured to the end tab and an inner conductor.

10. A transducer as set forth in claim 9 wherein said conductive strip has means for conductively receiving the inner conductor of the lead means.

11. A transducer as set forth in claim 10 wherein said conductive strip extends beyond the ground plane for enabling connection of the inner conductor to the conductive strip.

12. A transducer as set forth in claim 1 wherein said shield means comprises an absorbent paper wrapped about the unitary structure and having a conductive paint applied thereto, said paper being provided with a hole therein for receiving a conductive paint to provide electrical conductivity from the ground plane to the conductive paint that is applied to the paper.

13. A transducer as set forth in claim 1 wherein said piezoelectric transducers have defined therebetween a void space so as to minimize the lateral vibrations imposed on the piezoelectric crystals.

14. A transducer system as set forth in claim 1 wherein said ground plane is of elongated and substantially flat form having a width comparable to the transducer cross-dimension.

15. A transducer system as set forth in claim 1 wherein said conductive strip is elongated providing continuous electrical coupling across all transducers.

16. A transducer system as set forth in claim 15 wherein said ground plane is of elongated and substantially flat form having a width comparable to the transducer cross-dimension.

17. A transducer system as set forth in claim 16 wherein said conductive strip is comprised of a circuit board more rigid than said conductive layer and including a dielectric base board carrying a conductive cladding defining the conductive strip.

18. A transducer system as set forth in claim 17 wherein said transducer are bonded only on their other side so as to stress the crystal and thus increase output voltage therefrom.

19. A transducer system as set forth in claim 18 wherein the bonded side of the transducers is on the side facing the strings with substantially all said other side being bonded.

20. A transducer system as set forth in claim 1 wherein said transducers are bonded only on their other side so as to stress the crystal and thus increase output voltage therefrom.

21. A transducer system as set forth in claim 20 wherein the bonded side of the transducers is on the side facing the strings with substantially all said other side being bonded.

22. A transducer system for a stringed musical instrument adapted to be positioned under the instrument saddle for coupling vibratory action from the instrument strings via the saddle to said transducer system, said transducer system comprising;

an electrically conductive ground plane, a plurality of piezoelectric transducers each adapted to be aligned with an instrument string and each having one and another side, said ground plane positioned at the one side of said transducers and receiving the one side of the transducers in electrically coupling contact therewith, a conductive trip positioned at the other side of said transducers, a resilient and electrically conductive layer disposed between said piezoelectric transducers and conductive strip, conductive adhesive means for securing the other side of the piezoelectric transducers to the conductive layer to form an elongated unitary structure that includes said ground plane with the piezoelectric transducers disposed between the ground plane and conductive layer and spacedly disposed so as to be in alignment with respective strings, said transducers being bonded only on their other side so as to stress the crystal and thus increse voltage therefrom, substantially the entire side of said transducers being bonded to provide the crystal stressing, conductive shield means disposed about said unitiary structure, means providing electrical contact between the shield means and ground plane, and electrical lead means connected to said ground plane and conductive strip.

23. A transducer system as set forth in claim 22 wherein the bonded side of the transducers is on the side facing the strings.

24. A transducer system as set forth in claim 22 wherein the ground plane is positioned at the one side of the transducers remote from the instrument strings.

25. A transducer system for a stringed musical instrument adapted to be positioned under the instrument saddle for coupling vibratory action from the instrument strings via the saddle to said transducer system, said transducer system comprsiing;

an electrically conductive ground plane, a plurality of piezoelectric transducers each adapted to be aligned with an instrument stirng and each having one and another side, said ground plane positioned at the one side of said transducers and receiving the one side of the transducers in electrically coupling contact therewith, a conductive strip positioned at the other side of said transducers, a resilient and electrically conductive layer disposed between said piezoelectric transducers and conductive strip, conductive adhesive means for securing the other side of the piezoleectric transducers to the conductive layer to form an elongated unitary structure that includes said ground plane with the piezoelectric transducers disposed between the ground plane and conductive layer and spacedly disposed so as to be in alignment with respective strings, said transducers being bonded only on their other side so as to stress the crystal and thus increase voltage therefrom, at least a major portion of the other side of said transducers being bonded to provide the crystal stressing, conductive shield means disposed about said unitary structure, means providing e1ectrical contact between the shield means and ground plane, and electrical lead means connected to said ground plane and conductive strip.

26. A transducer system as set forth in claim 25 wherein the bonded side of the transducers is on the side facing the strings.

27. A transducer system as set forth in claim 25, wherein the ground plane is positioned at the one side of the transducers remote form the instrument strings.

28. A transducer system for a stringed musical instrument adapted to be positioned under the instrument saddle for coupling vibratory action from the instrument strings via the saddle to said transducer system, said transducer system comprising;

a first electrically conductive member, a plurality of piezoelectric transducers each adapted to be aligned with an instrument stirng and each having one and another side, said first electrically conductive member positioned at the one side of said transducers and receiving the one side of the transducers in electrically coupling contact therewith, a second electrically conductive member positioned at the other side of said transducers, conductive adhesive means for securing the other side of the piezoelectric transducers to the second electrically conductive member to form an elongated unitary structure that includes said first electrically conductive member with the piezoelectric transducers disposed between the first electrically conductive member and the second electrically conductive member and spacedly disposed so as to be in alignment with respective strings, said transducers being bonded only on their other side so as to stress the crystal and thus increase voltage therefrom, at least a major portion of the other side of said transducers being bonded to provide the crystal stressing, conductive shield means disposed about said unitary structure, means providing electrical contact between the shield means and first electrically conductive member, and electrical lead means connected to said first and second electrically conductive members.

29. A transducer system as set forth in claim 28 wherein said second electrically conductive member includes a conductive strip positioned at the other side of said transducers and a resilient and electrically conductive layer disposed between said piezoelectric transducers and conductive strip.

30. A transducer system as set forth in claim 28 wherein said first electrically conductive member is of elongated and substantially flat form having a width comparable to the transducer cross-dimension and said electrically conductive member is likewise elongated and substantially flat providing continuous coupling across all transducers.

* * * * *